US005230210A

United States Patent [19]

Barritt et al.

[11] Patent Number: 5,230,210

[45] Date of Patent: Jul. 27, 1993

[54] NOZZLE FOR GENERATING A TWIST IN A JET SPINNING MACHINE

[75] Inventors: Andrew Barritt, Winterthur; Herbert Stalder, Kollbrun, both of Switzerland

[73] Assignee: Maschinenfabrick Rieter AG, Winterthur, Switzerland

[21] Appl. No.: 794,569

[22] Filed: Nov. 19, 1991

[30] Foreign Application Priority Data

Dec. 6, 1990 [CH] Switzerland ..... 3856/90

[51] Int. Cl.[5] ..... D01H 7/92

[52] U.S. Cl. ..... 57/333

[58] Field of Search ..... 57/333, 328, 350

[56] References Cited

U.S. PATENT DOCUMENTS

| | | | |
|---|---|---|---|
| 3,279,164 | 10/1966 | Breen et al. | 57/333 X |
| 3,505,803 | 4/1970 | Hughey | 57/333 X |
| 4,480,435 | 11/1984 | Anahara et al. | 57/333 |
| 4,503,662 | 3/1985 | Horiuchi et al. | 57/333 X |
| 4,858,288 | 8/1989 | Hodgin et al. | 57/333 X |
| 4,934,133 | 6/1990 | Stalder et al. | 57/333 |

FOREIGN PATENT DOCUMENTS

| | | | |
|---|---|---|---|
| 321885 | 6/1989 | European Pat. Off. . | |
| 2605942 | 8/1977 | Fed. Rep. of Germany . | |
| 3440 | 4/1989 | PCT Int'l Appl. . | |
| 1051140 | 10/1983 | U.S.S.R. | 57/333 |

*Primary Examiner*—Joseph J. Hail, III

*Attorney, Agent, or Firm*—Wolf, Greenfield & Sacks

[57] ABSTRACT

A nozzle mechanism for generating a twist in a yarn in an air-jet spinning machine, the nozzle comprising a central cylindrical duct having an axis through which a yarn is delivered in a selected direction and a bore having an axis and a diameter entering tangentially into the cylindrical duct for inputting compressed air into the duct, the bore entering the duct such that the axis of the bore forms an obtuse angle with the axis of the duct, the bore further entering the duct such that the perpendicular distance between the axis of the bore and the point of tangential entry of the bore into the duct is less than half the diameter of the bore.

13 Claims, 1 Drawing Sheet

NOZZLE FOR GENERATING A TWIST IN A JET SPINNING MACHINE

BACKGROUND OF THE INVENTION

The present invention relates to nozzles for generating a twist in a fiber sliver in textile spinning machines. Air injection nozzles having lateral bores entering a central yarn passage tangentially to the central passage are known. EP-A 0321885 describes a false twist air nozzle with a cylindrical, central yarn passage and tangentially arranged air injection bores opening into the central passage. Also described is a feed duct whose inner diameter is less than that of the central yarn passage leaving an extension which projects into a certain length of the cylindrical passage. The precise manner in which the air injection bores open into the duct is regarded as unimportant, and not described. One disadvantage of such a twist nozzle is that the nozzle is comprised of two components in conjunction with the feed duct and therefore requires considerably more mechanical processing.

DE-A-26'05'942 discloses a central yarn passage having several tangential compressed air injection bores opening directly into a yarn passage without describing the manner of bore entry. WO-A-89/03440 shows a central yarn passage having air injection ports with diameters increasing toward the point of entry into a central yarn passage. L'Industrie Textile, No. 1125 (September 1982), page 726 shows an air jet nozzle having four air infeed bores entering tangentially into a central yarn passage at a certain angle of inclination.

In general, where compressed air bores have been provided in an air jet nozzles for false twisting a yarn, it has been assumed that the bores should enter the central yarn passage in a perfect tangential manner.

SUMMARY OF THE INVENTION

It is an object of the invention to provide a nozzle for generating a twist having a smooth continuous yarn passage, with or without steps. Spinning results, which may be obtained with a novel nozzle according to the invention, at least with respect to the tension and strength of the yarn which is spun, are considerably and unexpectedly better relative to prior twist nozzles.

A further advantage of the present invention is that the yarn structure obtained is improved and maximum possible yarn production speeds can be achieved by employing novel and easily implementable changes in the production of the nozzle. A complex nozzle construction comprising a plurality of components is not required.

BRIEF DESCRIPTION OF THE DRAWINGS

Typical exemplary embodiments of the invention are described in detail with reference to the drawings, the same reference numerals referring to analogous structures, wherein.

DETAILED DESCRIPTION OF EXEMPLARY EMBODIMENTS OF THE INVENTION

Figure 1:
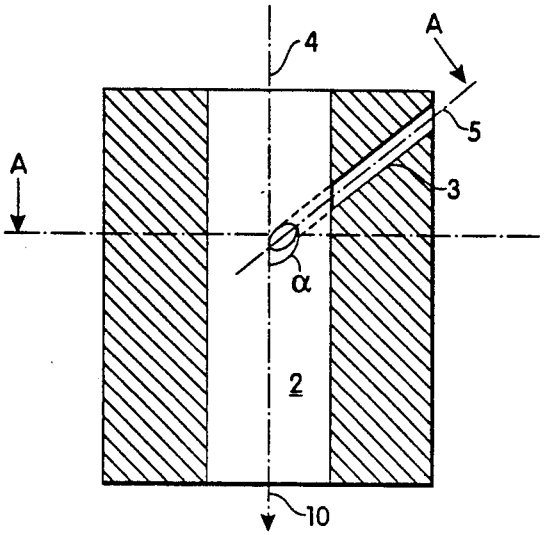
FIG. 1 is a schematic cross-sectional view of a twist nozzle according to the invention.

FIG. 1 shows a twist nozzle 1 in schematic illustration, the nozzle comprising a central cylindrical longitudinal duct 2 into which a cylindrical air injection bore 3 enters tangentially and at an obtuse angle $\alpha$ to the axis 4, which is usually between 120° and 150°.

Figure 2A:
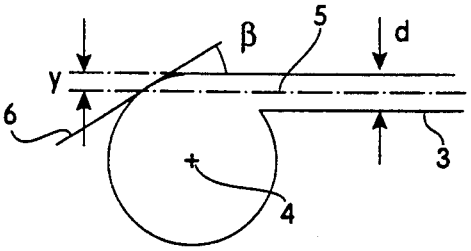
Fig. 2a (Prior Art)
FIGS. 2A and 2B are schematic cross-sectional views along stepped lines A—A showing only the compressed air bores opening into the longitudinal yarn passage of a twist nozzle according to the invention.
Figure 2B:
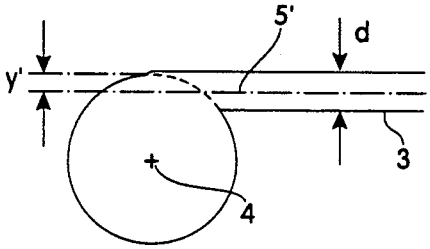

FIGS. 2A and 2B show alternative arrangements for the entry of a bore 3 as shown in FIG. 1 in a schematic cross section perpendicular to the axis 4 of the cylindrical longitudinal yarn passage 2. As shown in FIGS. 2A and 2B, the compressed-air bore 3 opens into the longitudinal duct 2 tangentially The central line or axis 5 of the compressed-air bore 3 forms an angle $\beta$ with tangent line 6 to the longitudinal duct 2 at the point of intersection of the axis 5 with the inner wall of the longitudinal duct 2. In FIG. 2A, the perpendicular distance y between the axis 5 and the furthest point along the wall of the duct 2 (in circular cross-section, as shown) which merges with the upper opening of the bore 3 into duct 2 is one-half of the diameter of the bore 3. That is, the bore 3 enters duct 2 in a perfect tangential manner. FIG. 2B shows essentially the same illustration as FIG. 2A, except that the compressed-air bore 3 having the same diameter enters tangentially into duct 2 in such a way that the perpendicular distance y' between the axis 5' of bore 3' and the furthest point of intersection of the wall of longitudinal duct 2 with the tangential opening of bore 3 into duct 2 is smaller than the distance y shown in FIG. 2A. That is, the distance y' between axis 5' and the surface of the inner wall of the longitudinal duct 2 is less than half of the diameter d of the compressed air bore 3.

Figure 3:
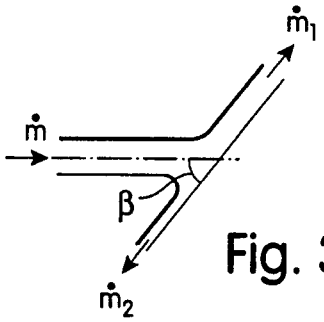
FIG. 3 shows an exemplary schematic pattern of the flow conditions in a twist nozzle according to the invention; and, FIG. 4 is a plot showing the relationship between the ratio of certain air mass flows shown in FIG. 3 and the distance between the axis of a tangential compressed-air bore and the inner wall of a longitudinal duct into which the air bore enters.

FIG. 3 shows the mass flows $\dot{m}$ of the compressed air when entering the longitudinal duct 2 having a configuration as shown in FIG. 2A. It is generally believed in the art that maximum twisting force of the compressed air can be achieved if the compressed-air bores enter the main yarn passage duct tangentially. In the case of perfect tangentiality as is shown in FIG. 2A, the main portion of the compressed-air flow impacts directly upon entry into passage 2 with the walls of the central bore 2 along the line of axis 5 at the angle $\beta$. The obligue impact of the compressed air jet on the wall of the central bore or duct 2 leads to the following distribution of the air jet in accordance with the theorem of momentum. As shown in FIG. 3, this obligue impact of the air jet m entering into the duct and impacting with the wall of the duct 2 actually results in one larger portion $m_1$ of the air jet $\dot{m}$ travelling into the duct in a direction having a longitudinal component in the same direction as the yarn travelling direction 10 as established by the obtuse angle $\alpha$ and another smaller portion $m_2$ travelling in a direction having a longitudinal component which is opposite to the longitudinal yarn-travelling direction 10. The portion $\dot{m}_1$ of the air jet thus contributes to the spinning of a yarn travelling in direction 10, FIG. 1, while portion $\dot{m}_2$ does not.

The following formula applies to the direction of the mass flow $m_1$:

$$\dot{V}_\rho \cos\beta = \dot{V}_{1\rho} - \dot{V}_{2\rho} \quad (1)$$

where $\rho$ is the atmospheric density or density of air, $\dot{V}$ is the rate of volume flow of air supplied through bore 3 ($\dot{V}_\rho$ corresponding to mass flow m in FIG. 3), $\dot{V}_1$ is the rate of air volume flow flowing in the direction of travel 10, FIG. 1, of the yarn through duct 2 ($\dot{V}_{1\rho}$ corresponding to mass flow $m_1$ in FIG. 3) and $\dot{V}_2$ is the rate of air volume flow travelling in the opposite direction of yarn travel in duct 2 ($\dot{V}_{2\rho}$ corresponding to mass flow $\dot{m}_2$ in FIG. 3) at a given atmospheric density, which can be assumed constant.

Since the volume flow $V_2 = V - V_1$ (continuity equation), it follows from equation (1) that:

$$\dot{V}_1 = \frac{\dot{V}(1 + \cos\beta)}{2} \quad (2)$$

$$\dot{V}_2 = \frac{\dot{V}(1 - \cos\beta)}{2} \quad (3)$$

and finally $$\frac{\dot{V}_2}{\dot{V}} = \frac{1 - \cos\beta}{2} = \frac{\dot{m}_2}{m} \quad (4)$$

Figure 4:
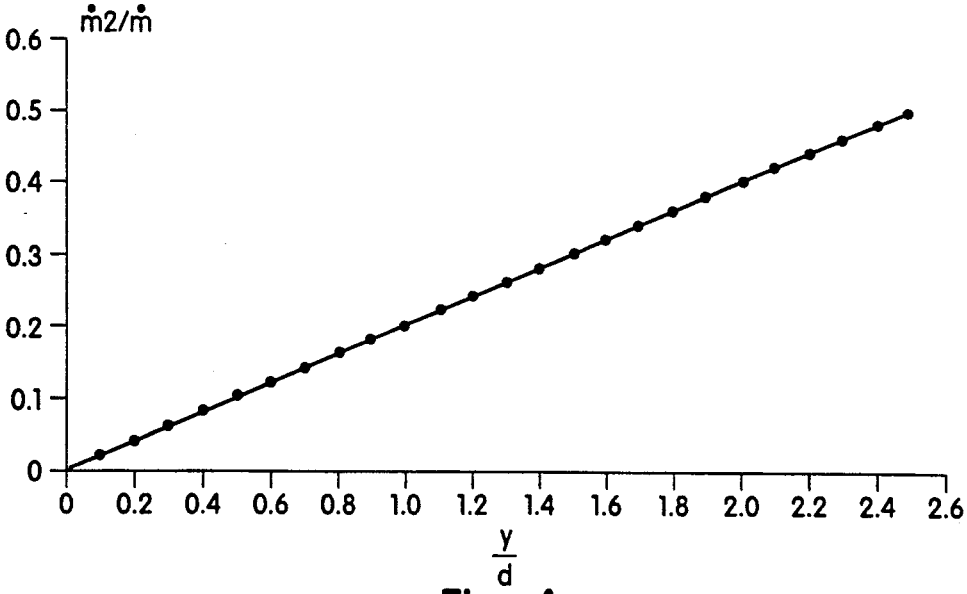

In FIG. 4 the mass flow ratio $\dot{m}_2/\dot{m}$ in the direction of the mass flow $\dot{m}_2$ (see FIG. 3) is plotted as a function of the distance y (as shown in FIG. 4, the x-axis is y/d and, inasmuch as d is constant, the plot is representative of a plot versus y as a variable). If the compressed-air bore 3 is precisely tangential (i.e., at y/d=0.5), the mass flow $\dot{m}_2$ is as much as 10 percent of the total flow $\dot{m}$ being input into bore 3. Thus the spinning efficiency of the compressed air is not optimal, because the mass flow $\dot{m}_2$ does not contribute to twisting of a yarn travelling through the nozzle in the direction 10 shown in FIG. 1. Traces of wear and tear on the nozzle have shown that the compressed air enters into the twist nozzle according to the flow diagram shown in FIG. 3. Trials carried out with nozzle configurations as described with reference to FIGS. 2A and 2B demonstrate that a configuration in accordance with that described with reference to FIG. 2B is preferable. Essentially higher yarn strengths and spinning tensions can be achieved where the distance y' is less than half the diameter d of the compressed air bore 3, and is greater than or equal to zero. Optimal results can be achieved where the distance y' ranges between about 3/10 and about ⅜ of diameter d. Thus, compared with a nozzle according to FIG. 2A (perfect tangentiality of the compressed-air bore 3), a nozzle configuration according to FIG. 2B can achieve either a 10 to 20 percent increase of the yarn feed speed having the same yarn quality or a spun yarn having an essentially higher yarn strength at the same feed speed. Various diameters for the central bore 2 and the compressed-air bore 3 were tested, such as in the range of 2 to 3 mm for the central yarn passage bore 2 and between 0.3 and 0.8 mm for the compressed air bore 3. Other alternatively sized ducts 2 and compressed air bores 3 may also be employed in implementing the invention.

It will now be apparent to those skilled in the art that other embodiments, improvements, details and uses can be made consistent with the letter and spirit of the foregoing disclosure and within the scope of this patent, which is limited only by the following claims, construed in accordance with the patent law, including the doctrine of equivalents.

What is claimed is:

1. A nozzle mechanism for generating a twist in a yarn in an air-jet spinning machine, the nozzle comprising a central cylindrical duct having a smooth wall surface and an axis, through which a yarn is delivered in a selected direction, and a bore having an axis and a diameter and a generally oval-shaped mouth entering into the cylindrical duct through the smooth wall surface of the duct for inputting compressed air into the duct, the mouth of the bore further entering the duct in a non-perfect tangential manner such that the perpendicular distance between a projection of the axis of the bore on a plane perpendicular to the axis of the duct and a line tangent to a circle defining the circumference of the duct which is parallel to and lies closest to said projection is less than half the diameter of the bore wherein the bore enters the duct such that the axis of the bore forms a selected angle with the axis of the duct, the compressed air input into the bore travelling through the bore and entering the duct at the selected angle, the ratio of mass flow of air input into the bore and mass flow of air entering the duct from the bore and travelling in a direction opposite to the selected angle of entry into the duct being greater than 10 to 1.

2. The nozzle mechanism of claim 1 wherein said perpendicular distance is between 0.30 and 0.37 of the diameter of the bore.

3. A nozzle mechanism for generating a twist in a yarn in an air-jet spinning machine, the nozzle comprising a central cylindrical duct having a smooth wall surface and an axis through which the yarn is delivered and a bore having an axis and a diameter and a generally oval-shaped mouth entering through the smooth wall surface into the cylindrical duct, the axis of the bore being disposed at a selected angle relative to the axis of the duct, compressed air being input into the bore and into the duct through the bore, the mouth of the bore entering the duct in a non-perfect tangential manner such that the perpendicular distance between a projecting of the axis of the bore on a plane perpendicular to the axis of the duct and a line tangent to a circle defining the circumference of the duct which is parallel to and lies closest to said projecting is less than half the diameter of the bore wherein the ratio of air mass flow input into the bore and air mass flow entering the duct from the bore and traveling in a direction opposite to the selected angle of entry into the duct is greater than 10 to 1.

4. The nozzle mechanism of claim 3 wherein said perpendicular distance is between 0.30 and 0.37 of the diameter of the bore.

5. A nozzle mechanism for generating a twist in a yarn in an air-jet spinning machine, the nozzle comprising a central cylindrical duct having an axis through which the yarn is delivered and a bore for input of compressed air into the duct, the bore having a diameter and an axis and a generally oval-shaped mouth entering into the cylindrical duct through a smooth wall surface of the duct the axis of the bore being disposed at a selected angle relative to the axis of the duct, the selected angle establishing a longitudinal direction of air flow through the duct, the yarn being delivered through the duct in the longitudinal direction, compressed air being input into the bore and into the duct through the bore, the bore being disposed relative to the duct such that the mouth of the bore enters the duct in a radially outwardly offset non-perfect tangential disposition wherein the mouth of the bore enters the duct in a non-perfect tangential disposition such that the ratio of air mass flow input into the bore and air mass flow entering the duct from the bore and travelling in a direction opposite to the longitudinal direction is greater than 10 to 1.

6. A nozzle mechanism for generating a twist in a yarn in an air-jet spinning machine, the nozzle comprising a central cylindrical duct having an axis through which a yarn is delivered in a selected direction and a bore having an axis and a diameter and a generally oval-shaped mouth entering into the cylindrical duct through a smooth wall surface of the duct for inputting compressed air into the duct, the bore entering the duct such that the axis of the bore forms a selected angle with the axis of the duct, the compressed air input into the bore travelling through the bore in the direction of the selected angle, the mouth of the bore further entering the duct in a non-perfect tangential manner such that the perpendicular distance between a projection of the axis of the bore on a plane perpendicular to the axis of the duct and a line tangent to a circle defining the circumference of the duct which is parallel to and lies closest to said projection is less than half the diameter of the bore, wherein the ratio of mass flow of air input into the bore and mass flow of air entering the duct from the bore and travelling in a direction opposite to the selected angle of entry into the duct is greater than 10 to 1.

7. The nozzle mechanism of claim 6 wherein said perpendicular distance is between 0.30 and 0.37 of the diameter of the bore.

8. A nozzle mechanism for generating a twist in a yarn in an air-jet spinning machine, the nozzle comprising a central yarn passage duct through which a yarn is delivered in a selected longitudinal direction and a bore having an axis and a mouth entering the duct for inputting compressed air into the bore through the mouth and into the duct, the entire mass of compressed air input into the bore flowing through the bore in a direction along the axis of the bore toward the duct and being split upon exiting the mouth into a component of air flow travelling in a direction opposite to the direction of air flow through the bore, the mouth entering the duct such that the mass of the component of split air flow exiting the mouth and flowing in the direction opposite to the direction of flow through the bore is less than ten percent of the entire mass of compressed air input into the bore, the mouth of the bore entering the duct in a non-perfect tangential manner, wherein the duct has an axis and the bore has a diameter, the bore being disposed relative to the duct such that the perpendicular distance between a projection of the axis of the bore on a plane perpendicular to the axis of the duct and a line tangent to a circle defining the circumference of the duct which is parallel to and lies closest to said projection is less than half the diameter of the bore.

9. The nozzle of claim 8 wherein the duct has a smooth wall surface and the mouth of the bore enters the duct through the smooth wall surface.

10. The nozzle of claim 9 wherein the mouth is generally oval-shaped.

11. A nozzle mechanism for generating a twist in a yarn in an air-jet spinning machine, the nozzle comprising a central yarn passage duct through which a yarn is delivered in a selected longitudinal direction and a bore having an axis and a mouth entering the duct for inputting compressed air into the bore through the mouth and into the duct, the entire mass of compressed air input into the bore flowing through the bore in a direction along the axis of the bore toward the duct and being split upon exiting the mouth into a component of air flow travelling in a direction opposite to the direction of air flow through the bore, the mouth entering the duct such that the mass of the component of split air flow exiting the mouth and flowing in the direction opposite to the direction of flow through the bore is less than ten percent of the entire mass of compressed air input into the bore, wherein the duct has an axis and the bore has a diameter, the bore being disposed relative to the duct such that the perpendicular distance between a projection of the axis of the bore on a plane perpendicular to the axis of the duct and a line tangent to a circle defining the circumference of the duct which is parallel to and lies closest to said projection is less than half the diameter of the bore.

12. The nozzle of claim 11 wherein the duct has a smooth wall surface and the mouth of the bore enters the duct through the smooth wall surface.

13. The nozzle of claim 12 wherein the mouth is generally oval-shaped.

* * * * *